US007150380B2

(12) United States Patent
Hoepner et al.

(10) Patent No.: US 7,150,380 B2
(45) Date of Patent: Dec. 19, 2006

(54) MULTI-FOLD CLOSURE

(75) Inventors: Travis J. Hoepner, Mukwonago, WI (US); Cori M. Blomdahl, Muskego, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 82 days.

(21) Appl. No.: 10/993,564

(22) Filed: Nov. 19, 2004

(65) Prior Publication Data

US 2006/0108381 A1 May 25, 2006

(51) Int. Cl.
*B67D 3/00* (2006.01)

(52) U.S. Cl. ..... 222/480; 220/265.3

(58) Field of Classification Search ..... 222/480, 222/556, 557; 220/254.3, 254.4, 254.5, 254.6, 220/259.2, 819, 822, 826
See application file for complete search history.

(56) References Cited

U.S. PATENT DOCUMENTS

| | | | | |
|---|---|---|---|---|
| 3,140,019 | A | 7/1964 | Barr | |
| 3,217,949 | A | 11/1965 | Davis | |
| 3,542,245 | A | 11/1970 | Hidding | |
| 4,163,496 | A | 8/1979 | Dogliotti | |
| 4,369,901 | A * | 1/1983 | Hidding | 222/480 |
| 4,488,667 | A | 12/1984 | Swett et al. | |
| 4,526,291 | A * | 7/1985 | Margulies | 221/63 |
| 4,658,980 | A | 4/1987 | Lindstrom | |
| 4,693,399 | A | 9/1987 | Hickman et al. | |
| 4,723,693 | A * | 2/1988 | DeCoster | 222/483 |
| 4,779,766 | A | 10/1988 | Kinsley | |
| 4,782,985 | A | 11/1988 | Kinsley | |
| 4,804,113 | A * | 2/1989 | Ciaccio | 222/142.1 |
| 4,881,668 | A | 11/1989 | Kitterman et al. | |
| D305,206 | S | 12/1989 | Hickman et al. | |
| 4,898,292 | A | 2/1990 | VerWeyst et al. | |
| 4,936,494 | A | 6/1990 | Weldman | |
| 4,955,513 | A | 9/1990 | Bennett | |
| 5,048,730 | A | 9/1991 | Forsyth et al. | |
| 5,219,100 | A | 6/1993 | Beck et al. | |
| 5,330,082 | A | 7/1994 | Forsyth | |
| 5,339,993 | A | 8/1994 | Groya et al. | |
| 5,415,312 | A | 5/1995 | Mueller | |
| 5,429,240 | A * | 7/1995 | Biebel et al. | 206/455 |
| 5,465,871 | A | 11/1995 | Robbins, III | |
| 5,509,582 | A | 4/1996 | Robbins, III | |
| 5,850,944 | A | 12/1998 | Robbins, III et al. | |
| 5,897,036 | A * | 4/1999 | DeCoster et al. | 222/480 |
| 5,971,231 | A | 10/1999 | Samz et al. | |
| 6,250,517 | B1 | 6/2001 | Samz et al. | |
| 6,279,788 | B1 * | 8/2001 | Lillelund et al. | 222/481 |
| 6,308,870 | B1 | 10/2001 | Samz et al. | |
| 6,341,720 | B1 | 1/2002 | Schmit et al. | |
| RE37,634 | E | 4/2002 | Hickman et al. | |
| 6,422,411 | B1 | 7/2002 | Gray | |
| 6,460,718 | B1 | 10/2002 | Vogel | |
| 6,464,113 | B1 | 10/2002 | Vogel | |
| 6,575,323 | B1 | 6/2003 | Martin et al. | |
| 6,616,016 | B1 | 9/2003 | Hicks et al. | |
| 6,691,901 | B1 | 2/2004 | Parve et al. | |
| 6,742,666 | B1 * | 6/2004 | Bried et al. | 215/235 |

(Continued)

*Primary Examiner*—Lien M. Ngo
(74) *Attorney, Agent, or Firm*—Wood, Phillips, Katz, Clark & Mortimer

(57) ABSTRACT

A dispensing closure system is provided with a peripheral wall or closure body for extending from a container. Two lids are molded with the body as a unitary structure, and the lids are closable over a pouring opening and a scooping opening.

12 Claims, 12 Drawing Sheets

U.S. PATENT DOCUMENTS

D494,812 S * 8/2004 Tremblay ..... D7/401
7,007,830 B1 * 3/2006 Parve et al. ..... 222/556
2003/0071041 A1 4/2003 Vogel
2003/0090036 A1 5/2003 Vogel

* cited by examiner

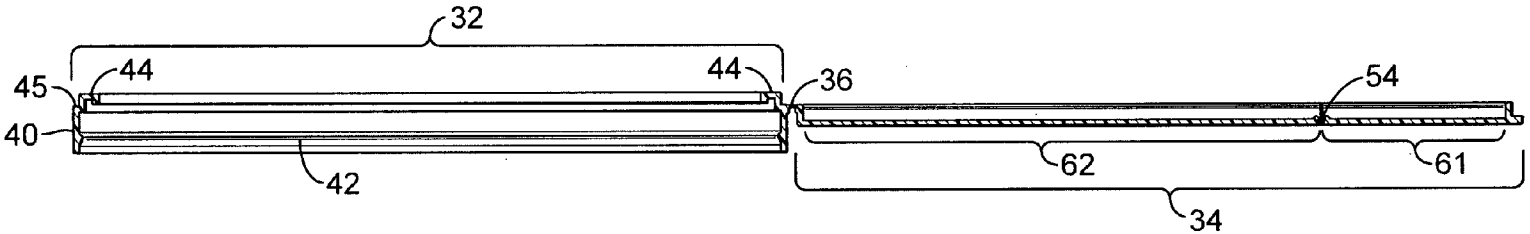
FIG. 7
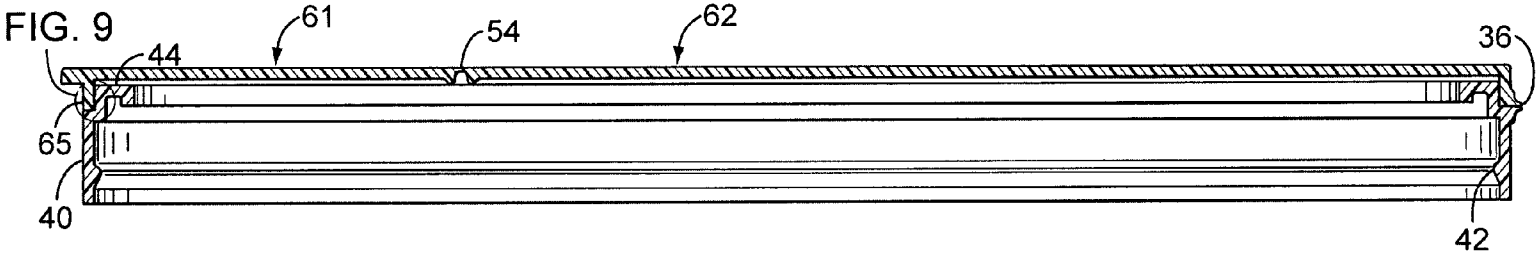
FIG. 8
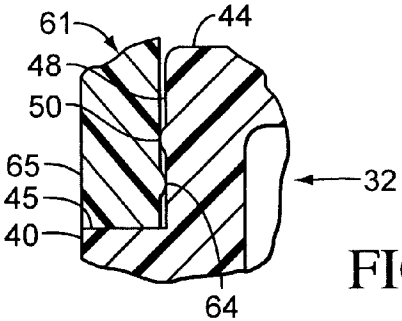
FIG. 9
FIG. 9

MULTI-FOLD CLOSURE

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a material from a container.

BACKGROUND OF THE INVENTION AND TECHNICAL PROBLEMS POSED BY THE PRIOR ART

There are a variety of types of conventional dispensing closures. One type of prior art dispensing closure system includes a body or base for being attached to the top of a container. The body defines a dispensing opening. The system further includes a lid which is hingedly mounted on the body and which can be lifted up to open the dispensing opening.

Dispensing closures are typically used for dispensing a product from a container. With some types of fluent material products, it would be desirable to provide a closure with a hinged top or lid structure that could accommodate pouring of the fluent material product through the closure, and also alternatively accommodate the insertion of a utensil through the open closure to permit the fluent material product to be scooped out or ladled out of the container. Such a closure could also permit the user to scoop or ladle out products such as nuts, candy, cookies, crackers, etc.

It would be advantageous if an improved dispensing closure could be provided that would be readily adjustable to accommodate the scooping out of various materials as well as the pouring or scooping out of a fluent material product.

It would also be advantageous if the lid structure of such an improved dispensing closure could be readily and easily manipulated as necessary to permit the closure either to be used for pouring a fluent product from the container or to accommodate the scooping of the fluent material product or other product out of the container.

Additionally, it would be beneficial if an improved dispensing closure could provide a relatively narrow pour stream of a the fluent material product and yet be wide enough to readily accommodate a conventional, wider container opening.

It would also be advantageous if such an improved dispensing closure could accommodate containers which have a variety of shapes and which are constructed from a variety of materials.

Such an improved dispensing closure should accommodate ease of use. Preferably, such an improved closure should also facilitate cleaning of the closure.

It would also be desirable if an improved dispensing closure could be molded as one piece, and not require assembly of multiple parts.

Further, it would be desirable if an improved dispensing closure could accommodate alternative designs for a narrow pour stream or a wider pour stream wherein the basic closure structure could be molded from one, common mold cavity to produce either of the designs.

It would also be beneficial if an improved dispensing closure could readily accommodate its manufacture from a variety of different materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The dispensing closure system of the present invention can accommodate designs that include one or more of the above-discussed desired features.

According to one aspect of the present invention, a first form of a dispensing closure system is provided for a container that has an interior where a fluent material product or other type of product may be stored. The closure system includes a peripheral wall for extending from the container around an opening to the container interior, and includes a top that is unitary with the peripheral wall.

The peripheral wall defines a first access region and a second access region. The first access region has a first configuration and a size to accommodate pouring of the product out of the container. The first access region has a wide end and has a narrow end with a converging shape for pouring. The second access region has a second configuration and a size to accommodate scooping of the product out of the container interior.

The top includes a first lid, a second lid, and a first film hinge for connecting the first lid with the second lid to accommodate movement of the first lid between a closed position occluding the first access region and an open position exposing the first access region. A second film hinge is provided unitary with both the peripheral wall and the second lid for connecting the second lid with the peripheral wall to accommodate movement of the second lid between a closed position occluding the second access region and an open position exposing the second access region.

According to another aspect of the invention, a second form of a dispensing closure system is also provided for a container that has an interior where a fluent material product or other product may be stored. The second form of the closure system includes a peripheral wall for extending from the container around an opening to the container interior. A top is provided that is unitary with the peripheral wall. The top includes a stationary panel that is unitary with the peripheral wall and that extends across the peripheral wall to define a first access region separated by the stationary panel from a second access region. The first access region has a first configuration and a size to accommodate pouring of the product out of the container. The first access region has a wide end adjacent the stationary panel and has a narrow end that (1) is located away from the stationary panel, and (2) has a converging shape for pouring. The second access region has a second configuration and a size to accommodate scooping of the product out of the container interior.

The top includes a first lid and a second lid. A first film hinge connects the first lid with the stationary panel to accommodate movement of the first lid between a closed position occluding the first access region and an open position exposing the first access region. A second film hinge connects the second lid with the stationary panel to accommodate movement of the second lid between a closed position occluding the second access region and an open position exposing the second access region.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 7 is an enlarged, cross-sectional view taken generally along the plane 7—7 in FIG. 4;

FIG. 8 is an enlarged, cross-sectional view taken generally along the plane 8—8 in FIG. 1;

FIG. 9 is an enlarged, fragmentary, cross-sectional view of the region in FIG. 8 indicated by the circle designated "FIG. 9";

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing system of this invention is described in a generally upright orientation that it could have at the upper end of a container when the container is stored upright on its base. It will be understood, however, that the dispensing system of this invention may be manufactured, stored, transported, used, and sold in orientations other than the position described.

The dispensing system of this invention is suitable for use with a variety of conventional or special containers having various designs, the details of which, although not illustrated or described, would be apparent to those having skill in the art and an understanding of such containers. With respect to the illustrated embodiments of the invention described herein, the container, per se, forms no part of, and therefore is not intended to limit, the broadest aspects of the present invention. It will also be understood by those of ordinary skill that novel and non-obvious inventive aspects are embodied in the described exemplary dispensing system alone.

Figure 1:
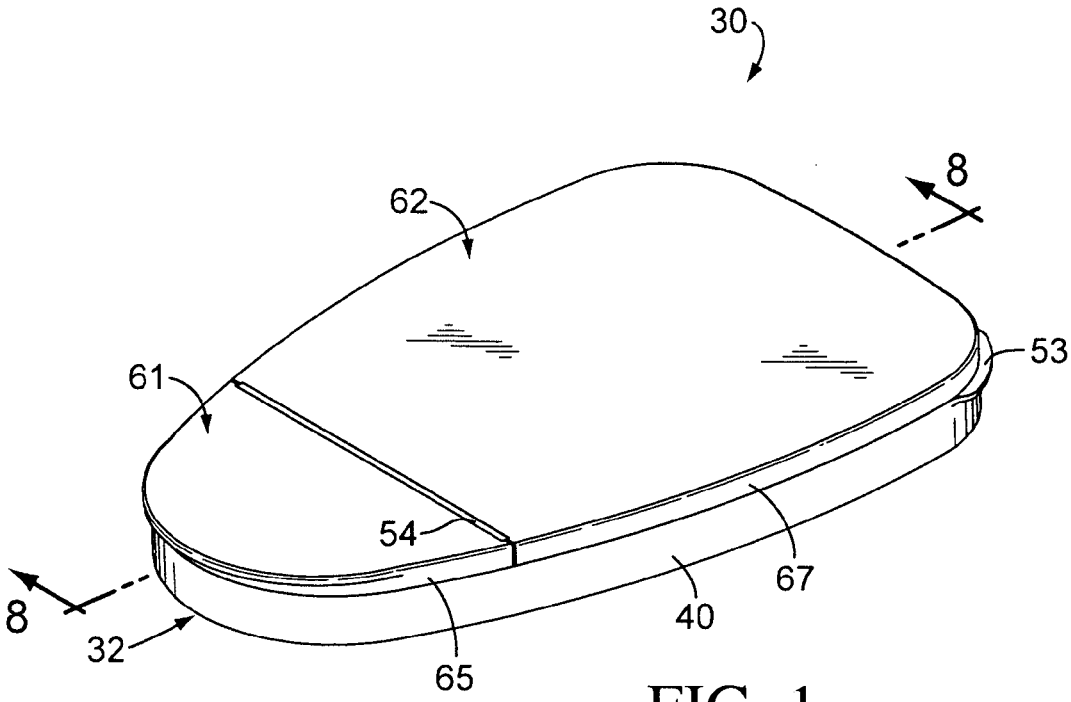
FIG. 1 is a perspective view of a first embodiment of a dispensing closure system of the present invention as embodied in a dispensing closure for use on, or as part of, a container (not illustrated), and the dispensing closure is shown in a completely closed condition.

One presently preferred first embodiment of a dispensing closure system of the present invention is in the form of a dispensing closure assembly illustrated in FIGS. 1–9 and is designated generally therein by reference number 30 in FIG. 1. The dispensing closure assembly 30, which is hereinafter sometimes referred to more simply as the "closure 30," is provided as a separately manufactured unit for mounting to the top of a container (not shown). It will be appreciated, however, that in some applications it may be desirable for the dispensing closure 30 to be formed as a unitary part, or extension, of the container wherein the unitary part or extension defines a dispensing end structure of the container, per se.

The container (not shown) typically has a conventional mouth which provides access to the container interior and product contained therein. The product may be, for example, nuts, candies, crackers, cookies, etc., which can be scooped out or ladled out of a container. The product may also be a more highly fluent material that can be poured, as well as scooped out, or ladled out, such as ground coffee, sugar, or other material, such as liquids, powders, slurries, etc. Such materials may be sold, for example, as a food product, a personal care product, an industrial or household product, or other composition (e.g., for internal or external use by humans or animals, or for use in activities involving medicine, manufacturing, commercial or household maintenance, construction, agriculture, etc.).

The container typically may have a neck or other suitable structure defining the container mouth having a cross-sectional configuration with which the closure 30 is adapted to engage. The body of the container may have another cross-sectional configuration that differs from the cross-sectional configuration of the container mouth. The container may, on the other hand, have a substantially uniform shape along its entire length or height without any neck portion of reduced size or different cross-section.

The container may or may not be a squeezable container having a flexible wall or walls which can be grasped by the user and compressed somewhat. However, the closure 30 is especially suitable for use with a container that has substantially inflexible walls that are not intended to be squeezed by the user.

Figure 2:
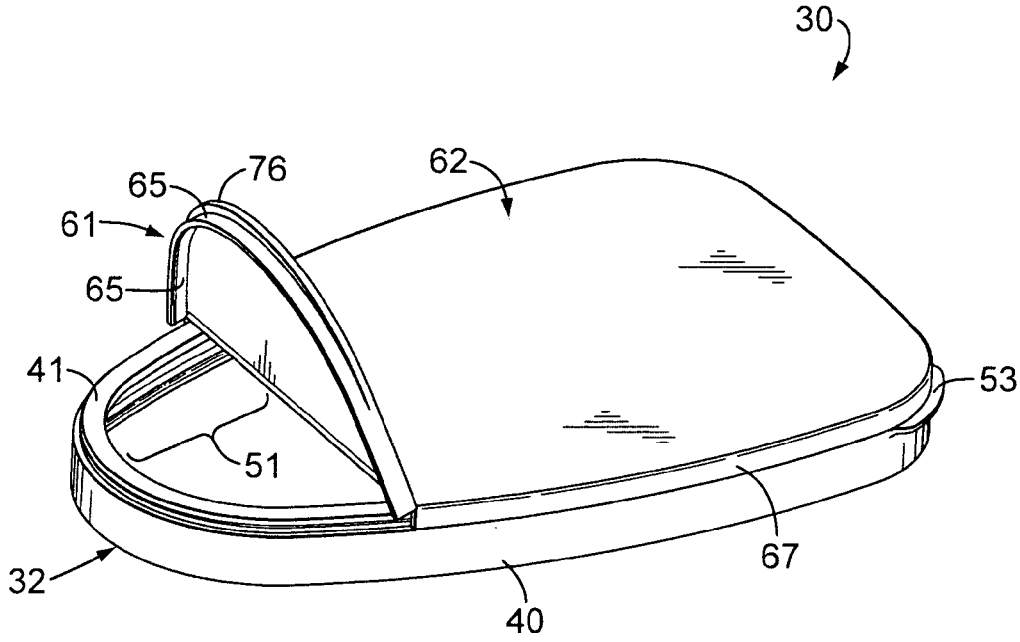
FIG. 2 is a view similar to FIG. 1, but FIG. 2 shows one of two lids on the dispensing closure top moved to an open position.
Figure 3:
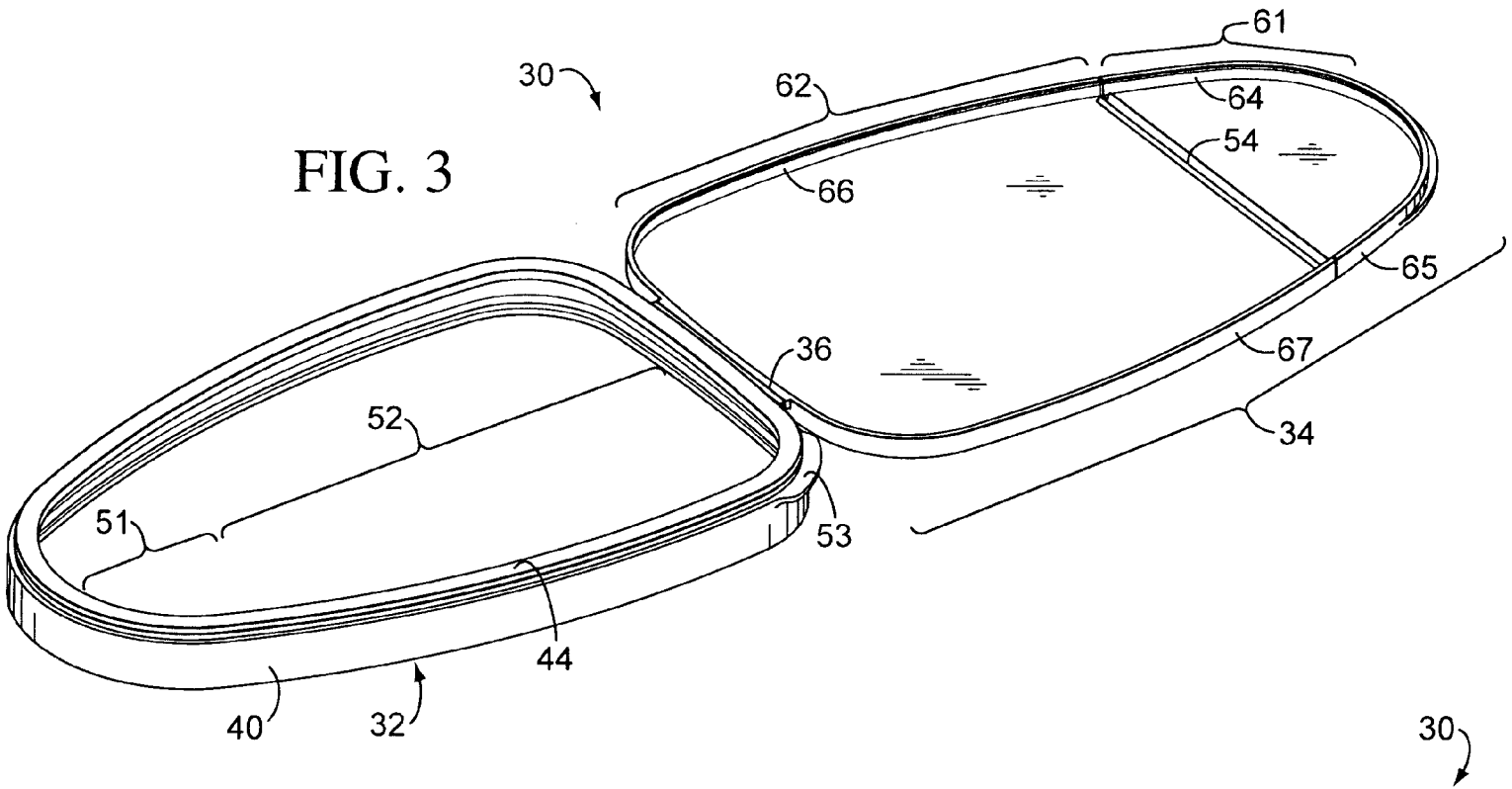
FIG. 3 is a perspective view of the first embodiment of the dispensing closure illustrated in FIG. 1, but in FIG. 3, both of the lids are shown in an open position.
Figure 6:
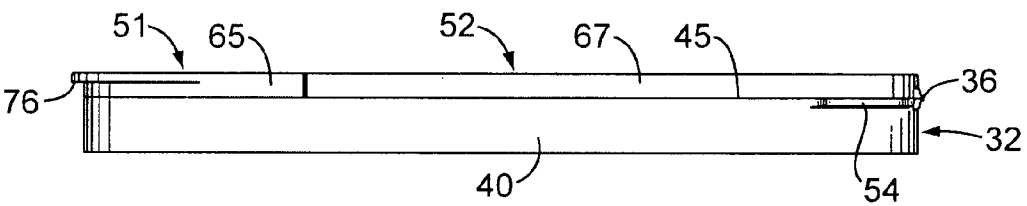
FIG. 6 is a side elevational view of the completely closed closure shown in FIG. 1.

As shown in FIG. 3 for the first embodiment, the preferred structure of the closure 30 comprises a peripheral wall that defines a base or body 32, and a top 34 joined to the peripheral wall base or body 32 by a hinge 36 which may be of any suitable conventional film hinge design known in the closure art, or which may be of a special design, the details of which form no part of the present invention. In the preferred, first embodiment illustrated in FIGS. 1–12, the closure peripheral wall (e.g., body 32), top 34, and hinge 36 are molded as a unitary structure from a suitable thermoplastic material such as polypropylene or the like. Other materials may be employed instead.

In other contemplated embodiments, the closure 30 need not be a structure that is completely separate from the container. Instead, the container could be made with a dispensing end structure that incorporates the closure 30 as a unitary part of the container. In such an alternative, the illustrated first embodiment closure 30 could be modified so that it is formed as an extension of the container, and the extending portion defining the body 32 could then be characterized as a structural feature that functions to accommodate communication with the container interior.

In either of the above-discussed alternatives (i.e., a separate closure or a closure molded as an extension of a container), the container may have an initially open bottom end opposite the dispensing end on which the closure 30 is located, and such a bottom end could be used for accommodating the filling of the inverted container with the product to be dispensed. After the inverted container is filled with the product through the open bottom end of the container, the open bottom end of the container could be closed by suitable means, such as by a separate bottom end closure which could be attached to the container bottom end (e.g., through a suitable threaded engagement, snap-fit engagement, adhesive engagement, thermal bonding engagement, etc.). Alternatively, such an open bottom portion of the container could be deformed closed (e.g., with an appropriate process applying heat and force if the container bottom end portion is made from a thermoplastic material or other material that would accommodate the use of such a process).

The peripheral wall or body 32 may have a skirt 40 (FIGS. 7 and 8) with a conventional internal bead 42 for snap-fit engagement with a mating container groove (not shown) to secure the closure body 32 to the container (not shown).

The closure body 32 and container could also be releasably connected with a screw thread system (not shown), or by other means. Alternatively, the closure body 32 may be permanently attached to the container by means of induction bonding, ultrasonic bonding, gluing, or the like, depending upon the materials employed for the container and closure body 32.

The interior of the body 32 may also include special or conventional seal features to provide an enhanced leak-tight seal between the closure body 32 and the container. The illustrated snap-fit closure body 32 does not employ such an enhanced seal feature.

The illustrated preferred, first form of the closure body 32 defines an inwardly extending rim or top edge 44 (FIG. 3).

As shown in FIG. 7, the body 32 has an exterior peripheral shoulder 45 in the upper portion of the skirt 40. As can be seen in FIG. 9, at the inside of the shoulder 45 the closure body 32 has a generally upwardly extending, vertically oriented neck or sidewall 48. There is a peripheral latch bead 50 which projects laterally outwardly from the sidewall 48 at an elevation above the shoulder 45.

As can be seen in FIG. 3, a finger tab or thumb tab 53 projects laterally outwardly from the closure body skirt 40 at the same elevation as the closure body peripheral shoulder 45. This can facilitate removal of the entire closure 30 from the container when that is desired.

As can be seen in FIG. 3, the peripheral wall defined by the closure body 32 defines a first access region 51 and an adjacent second access region 52. The first access region 51 is adapted to be covered by a first lid 61 which is part of the top 34, and the second access region 52 is adapted to be covered by a second lid 62 which is part of the top 34. The lids 61 and 62 are connected or joined together by a film hinge 54. For convenience, the film hinge 54 may be regarded or characterized as a "first" film hinge for connecting the first lid 61 to the second lid 62, whereas the film hinge 36 may be regarded as the "second" film hinge for connecting the second lid 62 to the peripheral wall or closure body 32.

The first lid 61 includes a peripheral flange 65 (FIGS. 1 and 2), and the second lid 62 includes a peripheral flange 67 (FIGS. 1 and 2). The first lid flange 65 includes an inwardly extending latch bead 64 (FIG. 9). The flange 67 on the second lid 62 has a similar inwardly extending latch bead 66 (FIG. 3). When the first lid 61 is closed (FIGS. 8 and 9), the first lid flange latch bead 64 is spaced slightly below the closure body latch bead 50. If the first lid 61 is subjected to an upwardly directed force (e.g., from an unintentional impact or from an intentional push by a user's finger or thumb, then the first lid 61 may move slightly upwardly until the latch beads 64 and 50 engage. At this point, substantially greater force is required to move the latch bead 64 past and over the closure body latch bead 50. This arrangement of the latch beads 50 and 64 functions to hold the first lid 61 in the closed position during normal handling of the closure 30 and associated package. However, the latch bead arrangement accommodates deliberate opening of the lid 61 when a sufficient opening force is applied. Further, when the lid 61 is closed, the arrangement of the spaced-apart latch beads 50 and 64 accommodates slight variations in vertical dimensions owing to manufacturing tolerances. The second lid latch bead 66 functions in an analogous manner with the closure body latch bead 50.

With reference to FIG. 3, the first access region 61 may be characterized as having a first configuration and a size to accommodate pouring of the product out of the container, and the second access region 62 may be characterized as having a second configuration and a size to accommodate scooping of the product out of the container interior.

Figure 4:
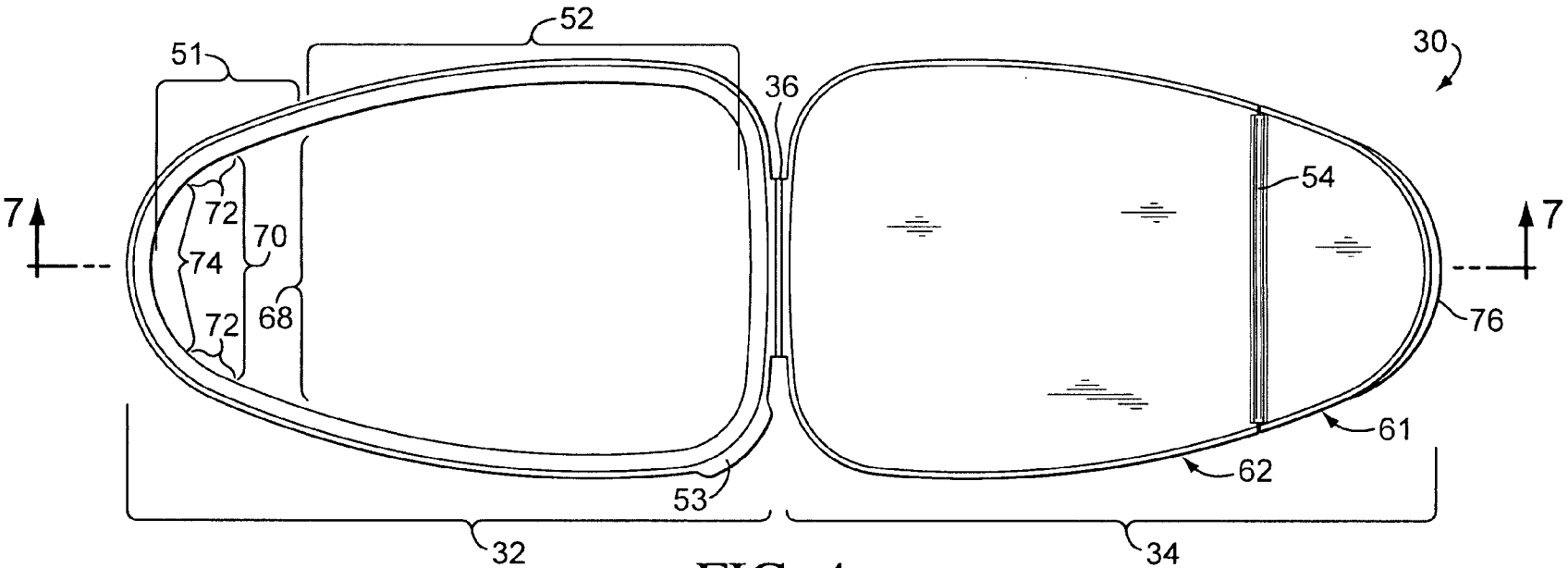
FIG. 4 is a top plan view of the fully open closure shown in FIG. 3.
Figure 5:
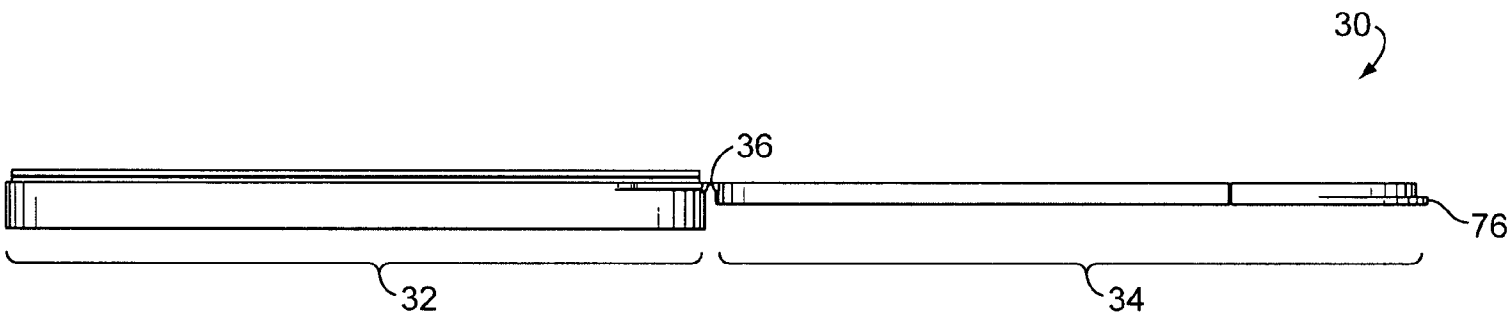
FIG. 5 is a side elevational view of the fully open closure shown in FIG. 4.

With reference to FIG. 4, the first access region 61 has wide end 68 adjacent the second access region 62. The first access region 61 also has a narrow end 70 with a converging shape for pouring. With continued reference to FIG. 4, the first access region narrow end 70 is defined, at least in part, by two arcuate side portions 72 which merge with an arcuate end portion 74 that has a radius less than the radius of each of the two arcuate side portions 72.

To assist in opening and closing the top 34, the first lid 61 includes an outwardly extending, or laterally extending, thumb lift 76 (FIGS. 2 and 4). When both lids 61 and 62 of the top 34 are closed (FIGS. 1 and 6), the first lid 61 can be readily opened if the user pushes up with sufficient force on the tab 76. The first lid 61 can be moved to the substantially vertical, opened position illustrated in FIG. 2. The container, to which the closure 30 is mounted, can then be inverted to pour the fluent material out through the first access recess 61 of the closure 30. The first film hinge 54 can be molded with sufficient bias in the open position so as to cause the first lid 61 to remain nearly perpendicular to the closure body 32 once the first lid 61 has been released from the closed position.

If it is desired to scoop or ladle the fluid contents out of the container, then the second lid 62 can also be lifted upwardly, and the entire top 34 can be positioned in a fully opened configuration as shown in FIG. 3. This exposes the second access region 52 as well as the first access region 51 which together define a larger, combined access region when the top 34 is fully opened as shown in FIG. 3. The combined access region of the first access region 51 and second access region 52 provides an even greater area into which a utensil can be inserted, and from which the fluent contents can be scooped or ladled out of the container.

Figures 14, 15:
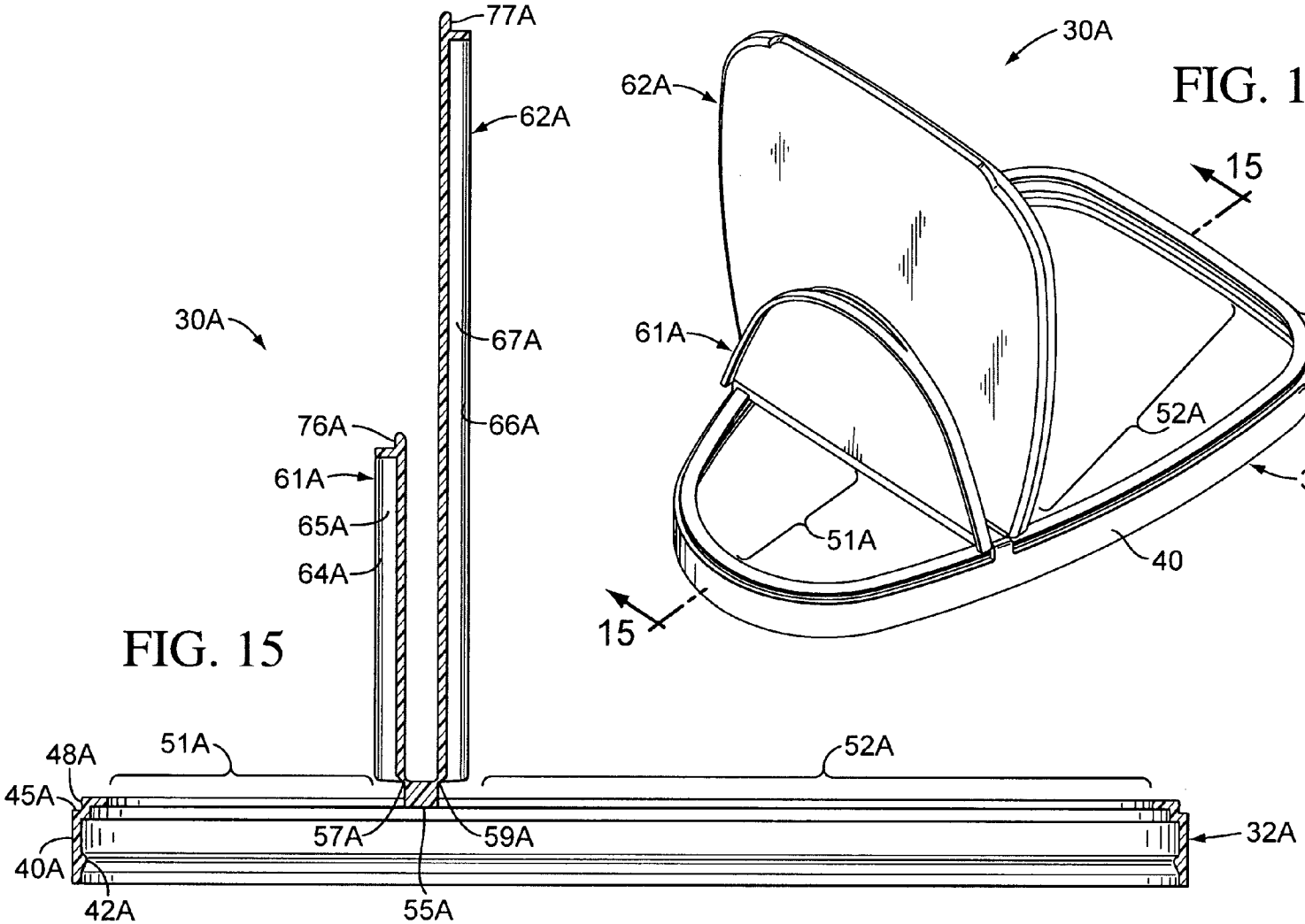
FIG. 14 is a view similar to FIG. 13, but FIG. 14 shows both of the lids moved to an open position.
FIG. 15 is a greatly enlarged, cross-sectional view taken generally along the plane 15—15 in FIG. 14.
Figure 16:
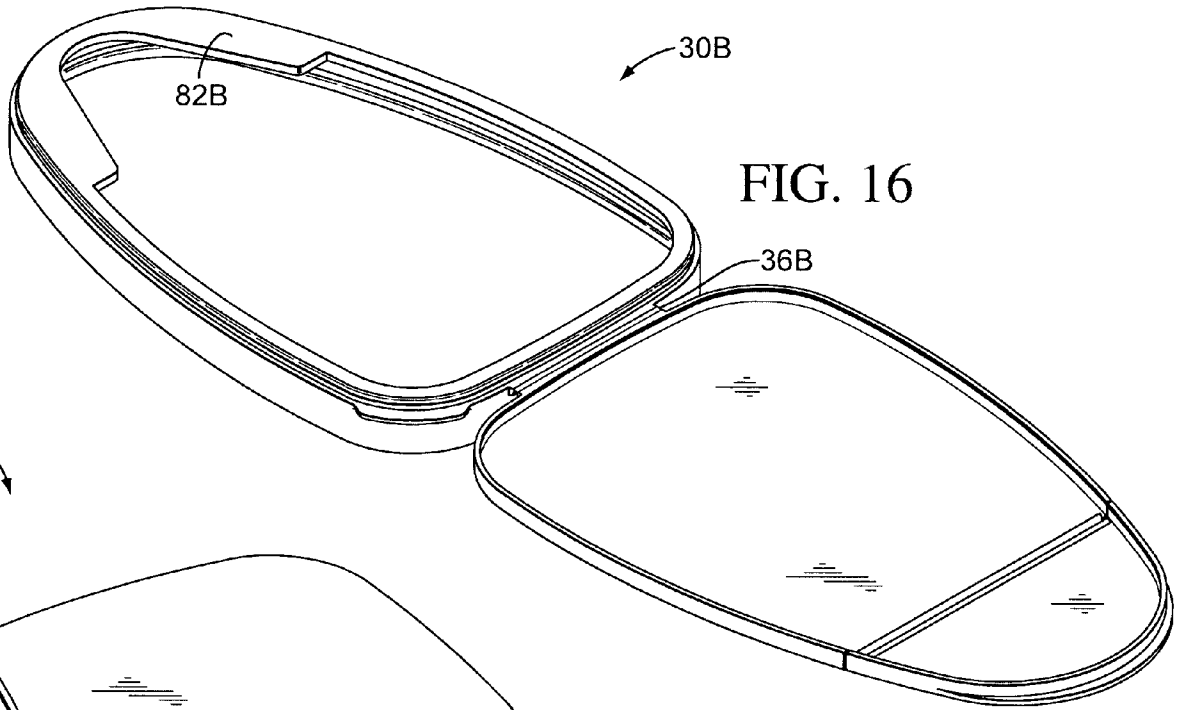
FIG. 16 is a perspective view of a third embodiment of a dispensing closure system of the present invention as embodied in a dispensing closure for use on, or as part of, a container (not illustrated), and the dispensing closure is shown with both lids of the top in an open configuration.
Figure 17:
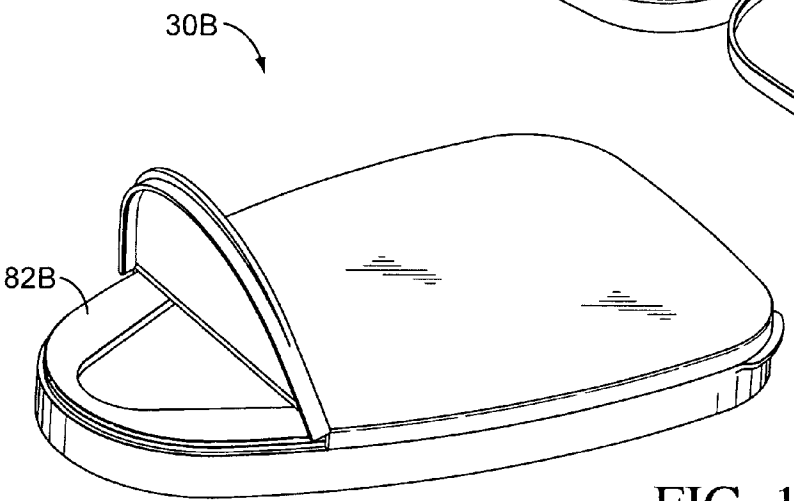
FIG. 17 is a perspective view of the third embodiment of the closure illustrated in FIG. 16, but FIG. 17 shows one of the two lids closed and the other of the two lids in an open position.

A second form or embodiment of a dispensing closure system 30A of the present invention is illustrated in FIGS. 10–15. The closure system or closure 30A includes a peripheral wall in the form of a closure body 32A which has a configuration substantially similar to the closure body 32 described above with reference to the first embodiment illustrated in FIGS. 1–9. As can be seen in FIG. 15, the closure body 32A includes a skirt 40A having a snap-fit bead 42A for mounting the closure body to a container in the same manner as described above with respect to the first embodiment of the closure body 32 illustrated in FIGS. 1–9.

The closure body 32A also includes a peripheral shoulder 45A and a short, peripheral neck or sidewall 48A which has a laterally projecting latch bead (not visible in the small scale drawings, but which is identical with the latch bead 50 described above with reference to the first embodiment illustrated in FIG. 9).

As can be seen in FIG. 15, the closure body 32A has a first access region 51A and a second access region 52A. The first access region 51A has a first configuration and a size to accommodate pouring of the product out of the container. The second access region 52A has a second configuration and a size to accommodate scooping of the product out of the container interior.

Figure 10:
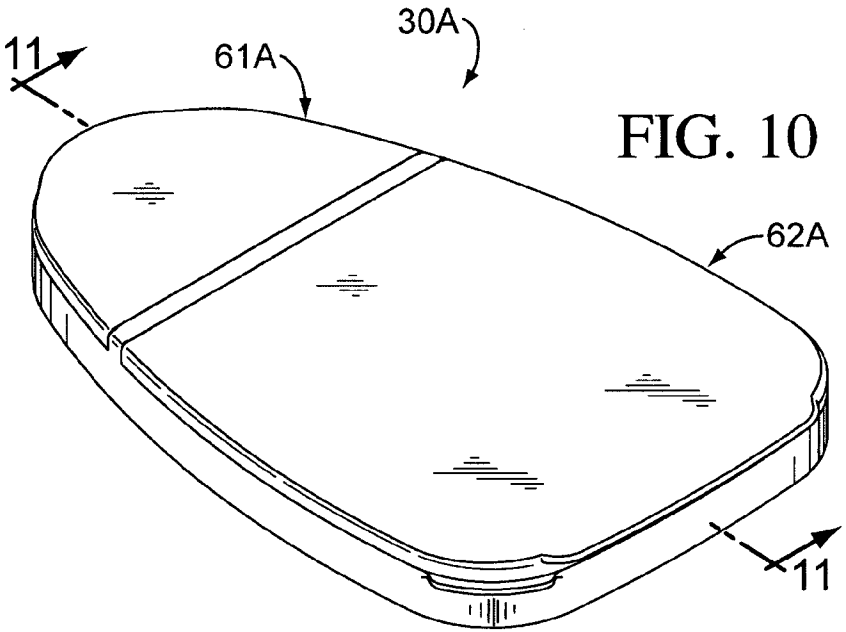
FIG. 10 is a perspective view of a second embodiment of a dispensing closure system of the present invention as embodied in a dispensing closure for use on, or as part of, a container (not illustrated), and the dispensing closure shown in a completely closed condition.
Figure 11:
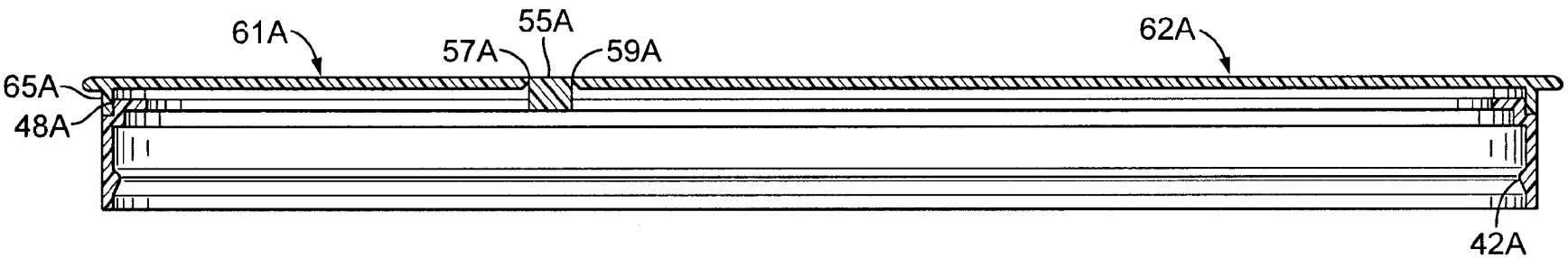
FIG. 11 is a greatly enlarged, cross-sectional view, taken generally along the plane 11—11 in FIG. 10.
Figure 12:
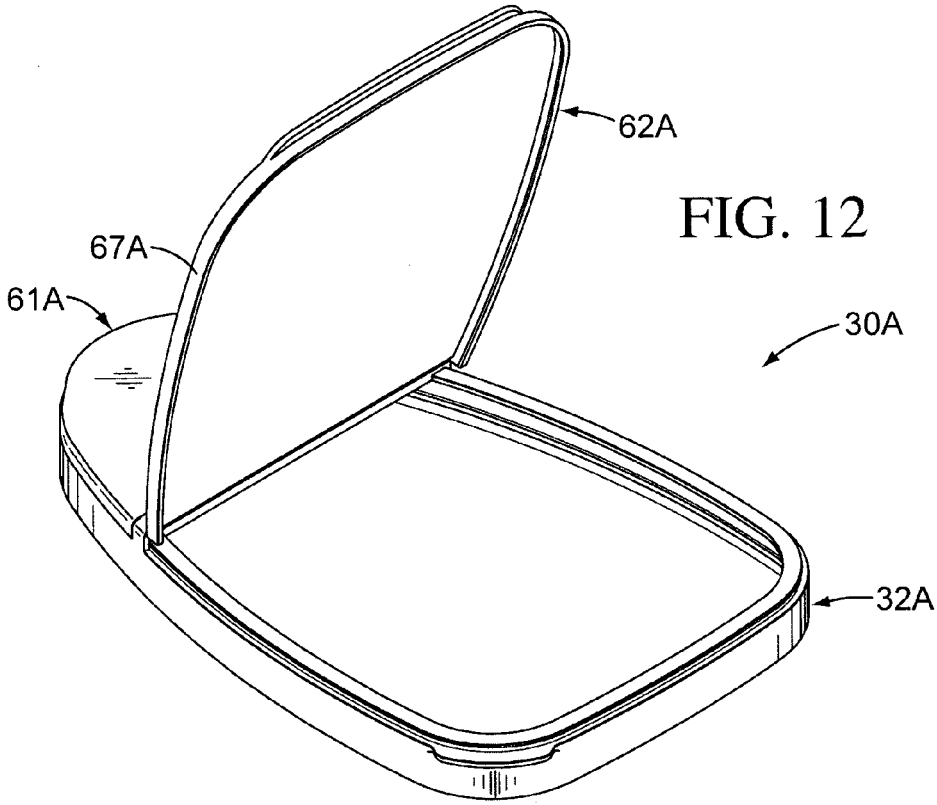
FIG. 12 is a view similar to FIG. 10, but FIG. 12 shows one of the two lids on the dispensing closure top moved to an open position.
Figure 13:
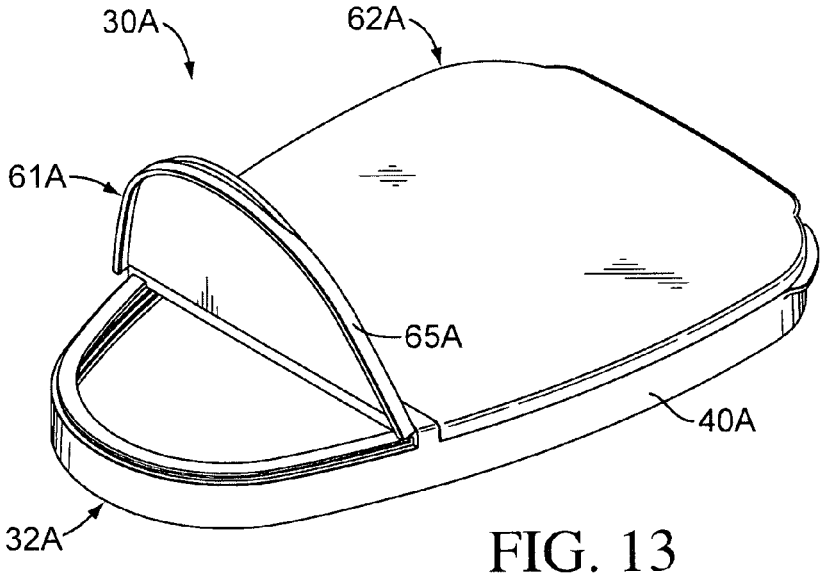
FIG. 13 is a perspective view of the second embodiment of the dispensing closure illustrated in FIG. 10, but FIG. 13 shows the other of the two lids on the dispensing closure top moved to an open position.

The first access region 51A is separated from the second access region 52A by a stationary panel 55A (FIG. 15) which is unitary with the closure body 32A, but which defines a portion of the closure top that comprises the stationary panel 55A, an attached first lid 61A, and an attached second lid 62A. As can be seen in FIG. 15, the first lid 61A is connected to the stationary panel 55A with a first film hinge 57A, and the second lid 62A is connected to the stationary pane 155A with a second film hinge 59A. The first lid 61A is adapted to cover the first access region 51A when the first lid 61A is closed (FIGS. 10–11). To this end, the first lid 61A has a flange 65A (for depending alongside the closure body neck or sidewall 48A (FIGS. 11 and 15) when the first lid 61A is closed). The flange 65A includes an inwardly projecting latch bead 64A for engaging a latch bead on the closure body neck 48A in the same way that the first embodiment closure lid latch bead 64 engages the closure body latch bead 50 as described above with reference to the first embodiment illustrated in FIG. 9.

The second lid 62A has a similar flange 67A with a latch bead 66A (FIG. 15) for engaging the closure body 32A in the same way.

As can be seen in FIG. 15, the first lid 61A has a lift tab 76A, and the second lid 62A has a lift tab 77A. The lids 61A and 62A can be lifted upwardly by applying force to the lift tabs 76A and 77A, respectively.

Except for the stationary panel 55A extending across the top of the closure body 32A, the closure body 32A defines the first access region 51A and the second access region 52A with substantially the same configurations as the first embodiment access regions 51 and 52, respectively, described above with reference to FIGS. 1–9. However, owing to the fact that the second embodiment lids 61A and 62A are each independently connected by a film hinge to the stationary panel 55A as can be seen in FIG. 15, each access region 51A and 52A can be accessed independently of the other. Thus, it is possible to keep the first access region 51A closed while lifting the second lid 62A to expose the second access region 52A—a feature not possible with the first embodiment of the closure 30 described above with reference to FIGS. 1–9. On the other hand, because the second embodiment of the closure 30A includes the stationary panel 55A extending across the top of the closure body 32A, unhindered access to the entire closure body 32A interior is not possible, whereas the entire closure top 34 of the first embodiment closure 30 can be moved to an open position so that there is no structure extending across the open closure body 32 to hinder complete access to either or both of the first access regions 51 and 52.

Figure 18:
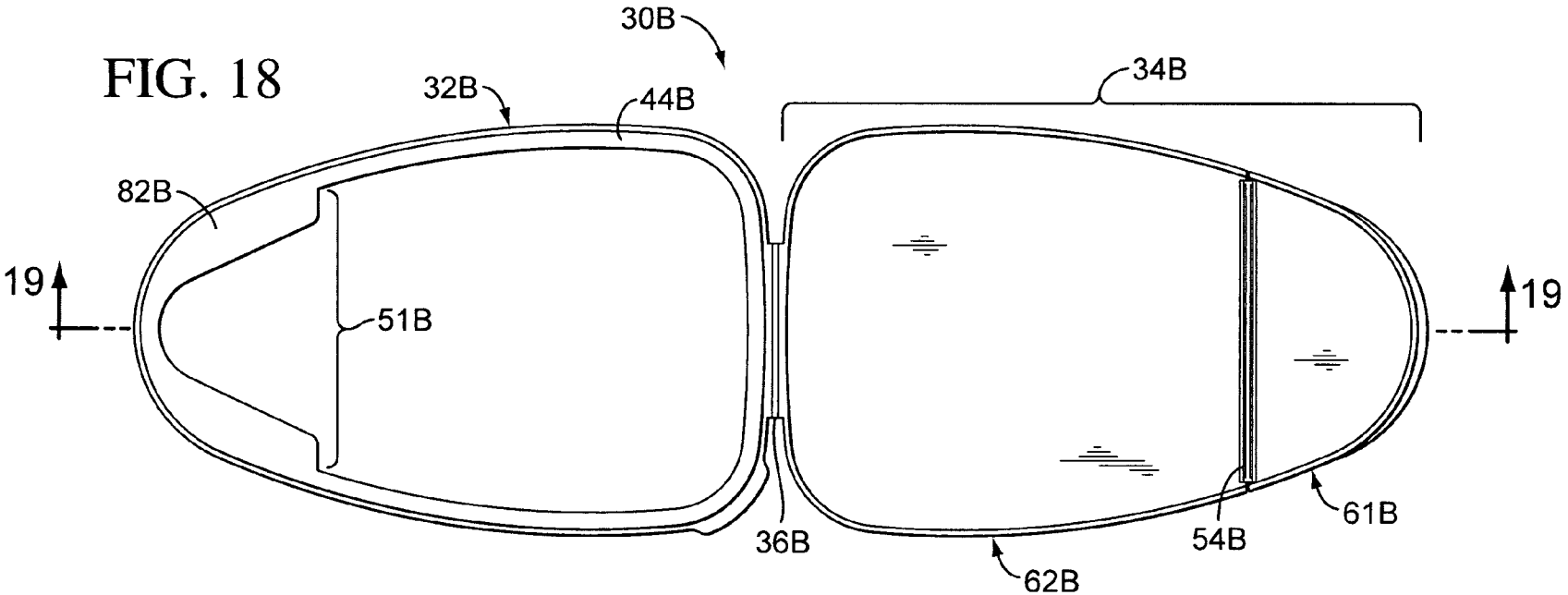
FIG. 18 is a plan view of the third embodiment of the dispensing closure illustrated in FIG. 16.
Figure 19:
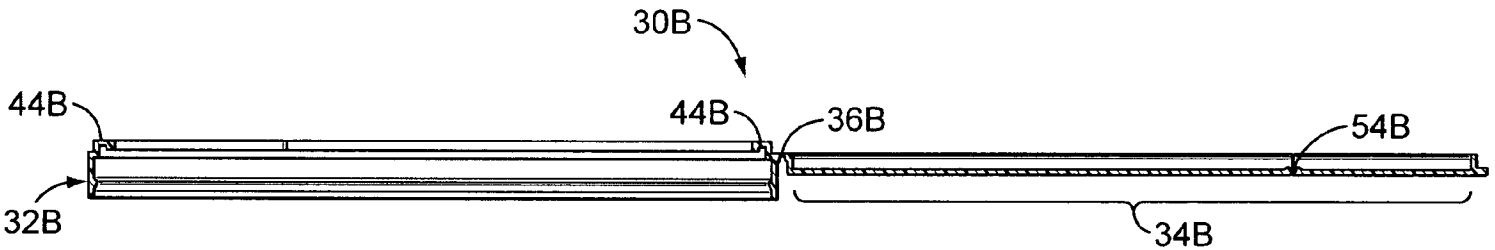
FIG. 19 is a cross-sectional view taken generally along the plane 19—19 in FIG. 18.
Figure 20:
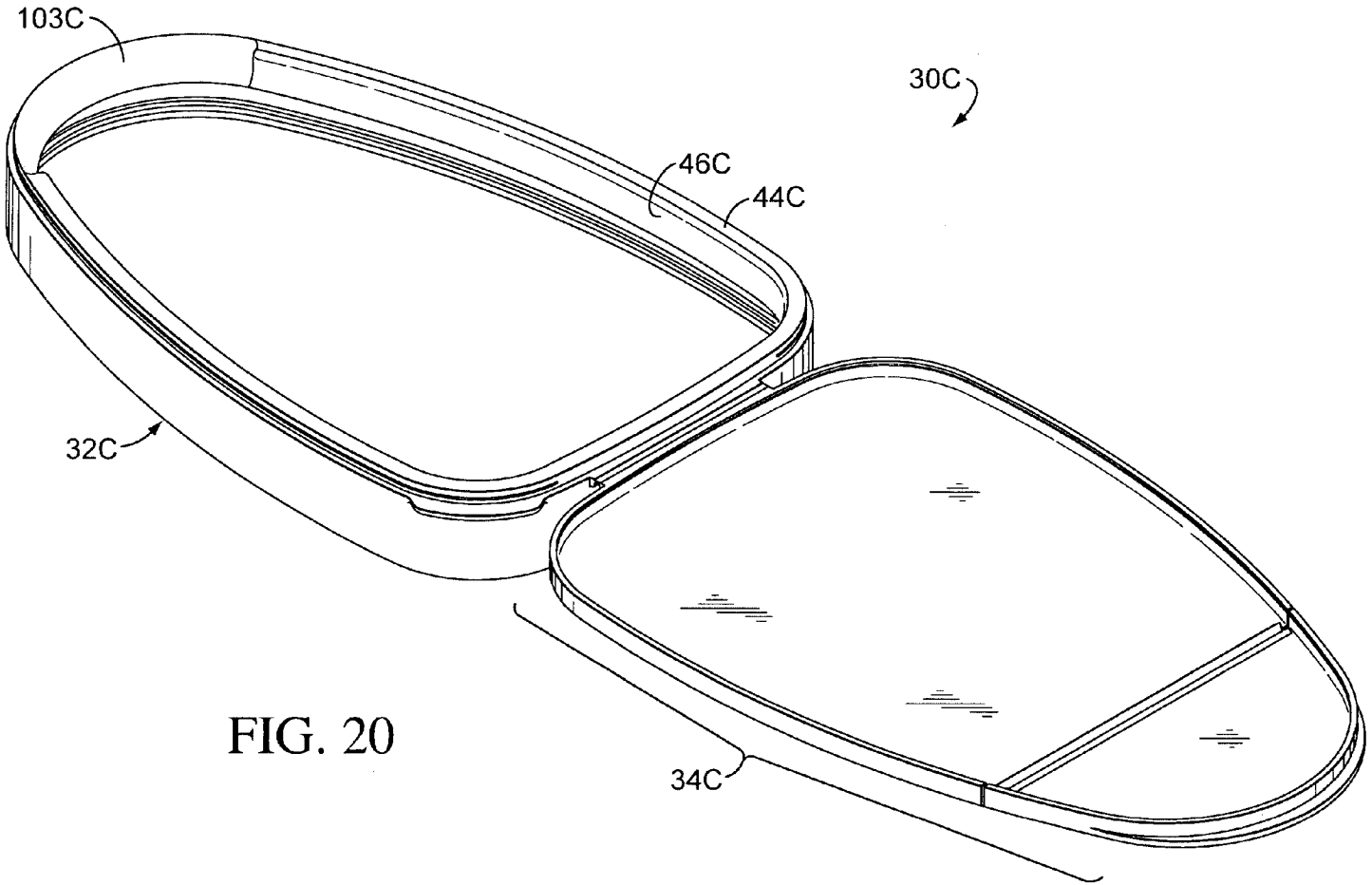
FIG. 20 is a perspective view of a fourth embodiment of a dispensing closure system of the present invention as embodied in a dispensing closure for use on, or as part of, a container (not illustrated), and the dispensing closure is shown with both lids of the top in an open configuration.

FIGS. 16–19 illustrate a third embodiment of the dispensing closure system 30B of the present invention. The third embodiment of the closure 30B is substantially similar to the first embodiment of the closure 30 described above with reference to FIGS. 1–9. As can be seen in FIG. 19, the third embodiment closure 30B has a closure body 32B connected with a film hinge 36B to a top 34B which includes a first lid 61B and a second lid 62B joined by a film hinge 54B.

The closure body 32B has an inwardly extending peripheral top edge 44B similar to the top edge 44 employed in the first embodiment closure 30 illustrated in FIG. 4, except that the third embodiment of top edge 44B merges with a larger, differently configured flange or shelf 82B at the pouring, narrow end of the first access region 51B (FIG. 18). The shelf 82B projects laterally inwardly and has a flat top surface that is coplanar with the top edge 44B of the closure body 32B. The shelf 82B functions as a flow restrictor member and makes the pouring area of the first access region 51B even more narrow. This is useful in some applications to help discharge a narrower stream of fluent material out of the open closure during dispensing. This allows the lower part of the closure body 32B (which is attached to the container) to be molded (or otherwise made) in a larger size to accommodate a wider mouth of a container. Most of the structure of the closure body 32B can be made larger so as to conform to the wide container opening, and that facilitates proper mounting of the body 32B and also provides a desired aesthetic appearance. However, the narrower pouring area defined by the inwardly extending shelf 82B will permit control to be exercised over the pouring operation, especially with respect to certain types of fluent material, such as ground coffee and sugar.

The use of the shelf 82B facilitates flexibility in manufacturing. For example, one common mold cavity could be used to produce either the first embodiment closure 30 or the third embodiment closure 30B. This is accomplished by using a removable mold insert in the common mold cavity to define the shelf 82B when molding the third embodiment closure 30B. The mold insert is removed when molding the first embodiment closure 30.

Figure 21:
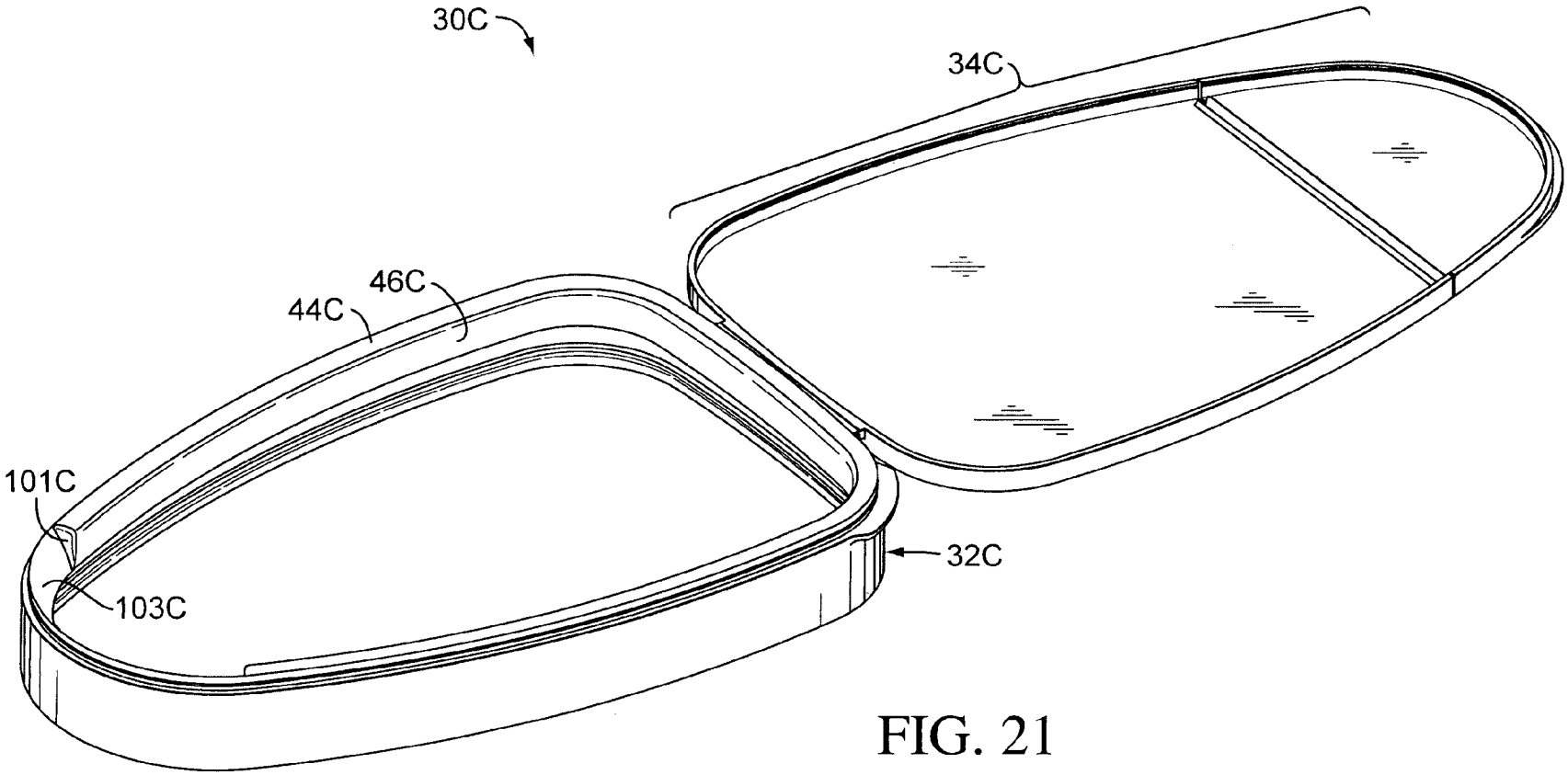
FIG. 21 is another perspective view of the open closure illustrated in FIG. 20.
Figure 22:
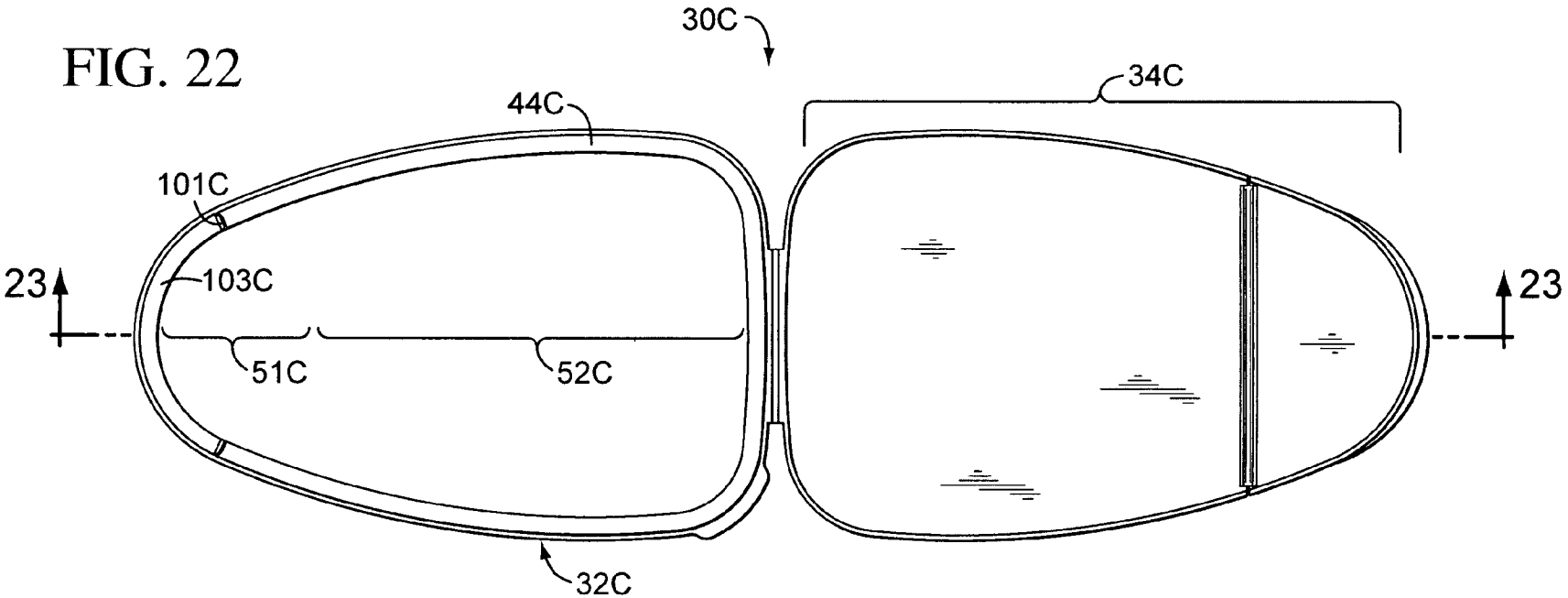
FIG. 22 is a top plan view of the open closure illustrated in FIGS. 20 and 21.
Figure 23:
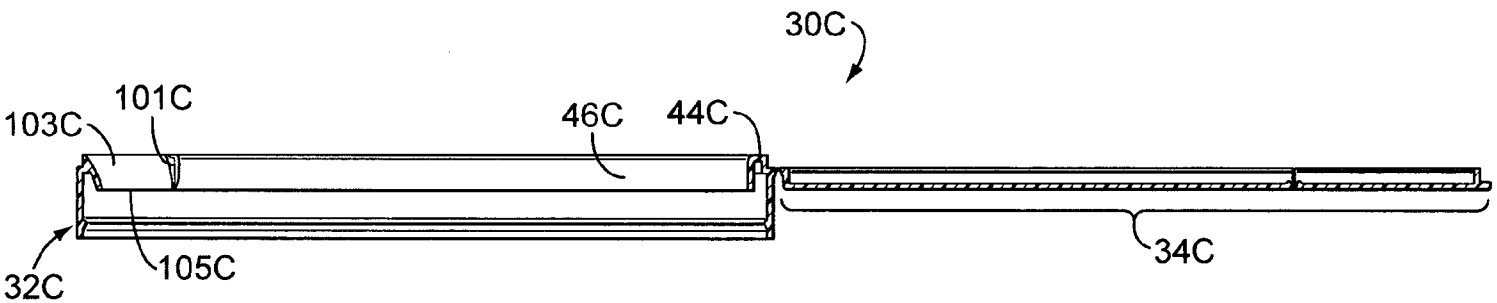
FIG. 23 is a cross-sectional view taken generally along the plane 23—23 in FIG. 22.

A fourth embodiment of the closure 30C is illustrated in FIGS. 20–23. The fourth embodiment 30C is similar to the third embodiment closure 30B described above with reference to FIGS. 16–19, except that the fourth embodiment closure 30C does not include the inwardly extending flat shelf 82B that is employed in the third embodiment of the closure 30B. In particular, the closure body 32C of the fourth embodiment of the closure 30C includes a top edge 44C which defines portions of the edge of the second access region 52C (FIG. 22) and which extends along portions of the edge of the first access region 51C. An inner flange 46C depends downwardly from the top edge 44C. The top edge 44C and flange 46C terminate laterally at the pouring end of the first access region 51C in an end wall 101C (FIGS. 21–23). Beyond the end wall 101C, the closure body 32C defines an arcuate ramp or spout feature 103C (FIGS. 20–23).

The ramp 103C provides advantages in certain pouring applications. In particular, some larger particulate items (e.g., snack food pieces having a diameter of about 3/16 of an inch or more) can flow more easily, and in a more constrained discharge configuration, over the ramp 103C.

Also, as can be seen in FIG. 23, the ramp 103C has a bottom edge 105C which can engage the top of a container (not shown) to prevent fluent material product from falling behind the ramp 103C when the material is poured. The bottom edge 105C continues as the bottom of the flange 46C so that the bottom of the flange 46C will also engage the top of the container to prevent fluent material from falling behind the flange 46C when the material is poured.

The flat shelf 82B and ramp 103C of the third and fourth embodiments, respectively, can also each be employed in modifications of the second embodiment closure 30A described above with reference to FIGS. 10–15.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure system for a container that has an interior where a fluent material product may be stored, said dispensing closure system comprising:

(A) a peripheral wall for extending from said container around an opening to the container interior, said peripheral wall defining a first access region and a second access region, said first access region having a first configuration and a size to accommodate pouring of said product out of said container, said first access region having a wide end and having a narrow end with a converging shape for pouring, said second access region being located adjacent said wide end of said first access region and having a second configuration and a size to accommodate scooping of said product out of said container interior;

(B) a top that is unitary with said peripheral wall and that includes:

(1) a first lid, (2) a second lid, and (3) a first film hinge for connecting said first lid with said second lid to accommodate movement of said first lid between a closed position occluding said first access region and an open position exposing said first access region; and (C) second film hinge that is unitary with said peripheral wall and with said second lid for connecting said second lid with said peripheral wall to accommodate movement of said second lid between a closed position occluding said second access region and an open position exposing said second access region; and in which said first lid and said second lid each has a peripheral flange for depending alongside an upper portion of said peripheral wall;

said peripheral flange of each said lid has a laterally inwardly extending latch bead; and said peripheral wall has a laterally outwardly extending latch bead for engaging said laterally inwardly extending latch bead of said first lid and for engaging said laterally inwardly extending latch bead of said second lid.

2. A dispensing closure system for a container that has an interior where a product may be stored, said dispensing closure system comprising:

(A) a peripheral wall for extending from said container around an opening to the container interior, said peripheral wall defining a first access region and a second access region, said first access region having a first configuration and a size to accommodate pouring of said product out of said container, said first access region having a wide end and having a narrow end with a converging shape for pouring, said second access region being located adjacent said wide end of said first access region and having a second configuration and a size to accommodate scooping of said product out of said container interior;

(B) a top that is unitary with said peripheral wall and that includes:

(1) a first lid, (2) a second lid, and (3) a first film hinge for connecting said first lid with said second lid to accommodate movement of said first lid between a closed position occluding said first access region and an open position exposing said first access region; and (C) second film hinge that is unitary with said peripheral wall and with said second lid for connecting said second lid with said peripheral wall to accommodate movement of said second lid between a closed position occluding said second access region and an open position exposing said second access region; and in which said peripheral wall at said first access region narrow end includes a member projecting laterally inwardly;

said peripheral wall has a top edge; and said member projecting laterally inwardly is a general flat shelf having a top surface that is coplanar with the top edge of said peripheral wall.

3. A dispensing closure system for a container that has an interior where a product may be stored, said dispensing closure system comprising:

(A) a peripheral wall for extending from said container around an opening to the container interior, said peripheral wall defining a first access region and a second access region, said first access region having a first configuration and a size to accommodate pouring of said product out of said container, said first access region having a wide end and having a narrow end with a converging shape for pouring, said second access region being located adjacent said wide end of said first access region and having a second configuration and a size to accommodate scooping of said product out of said container interior;

(B) a top that is unitary with said peripheral wall and that includes:

(1) a first lid, (2) a second lid, and (3) a first film hinge for connecting said first lid with said second lid to accommodate movement of said first lid between a closed position occluding said first access region and an open position exposing said first access region; and (C) second film hinge that is unitary with said peripheral wall and with said second lid for connecting said second lid with said peripheral wall to accommodate movement of said second lid between a closed position occluding said second access region and an open position exposing said second access region; and in which said peripheral wall at said first access region narrow end includes a member projecting laterally inwardly;

said peripheral wall has a top edge; and said member projecting laterally inwardly is an arcuate ramp that extends from said peripheral wall top edge laterally inwardly and downwardly into said first access region.

4. A dispensing closure system for a container that has a single, undivided, interior where a fluent material product may be stored, said dispensing closure system comprising:

(A) a peripheral wall for extending from said container around an opening to said container interior; and (B) a top that is unitary with said peripheral wall and that includes:

(1) a stationary panel that is unitary with said peripheral wall and that extends across said peripheral wall to define a single, undivided, first access region separated by said stationary panel from a single, undivided, second access region wherein (a) said first access region has a first configuration and a size to accommodate pouring of said product out of said container interior, (b) said first access region has a wide end adjacent said stationary panel and has a narrow end that (i) is located away from said stationary panel, and (ii) has a converging shape for pouring, and (c) said second access region has a second configuration and a size to accommodate scooping of said product out of said container interior;

(2) a first lid;

(3) a second lid;

(4) a first film hinge for a connecting said first lid with said stationary panel to accommodate movement of said first lid between a closed position occluding said first access region and an open position exposing said first access region and allowing access to all of the product in the single, undivided interior of the container; and (5) a second film hinge for connecting said second lid with said stationary panel to accommodate movement of said second lid between a closed position occluding said second access region and an open position exposing said second access region and allowing access to all of the product in the single, undivided interior of the container.

5. The system in accordance with claim 4 in which said system is a dispensing closure for a container that has an opening to the container interior, said closure being separate from, but releasably attachable to, said container around said opening.

6. The system in accordance with claim 4 in which said first access region narrow end is defined at least in part by two slightly arcuate side portions which merge with a more arcuate portion extending between the two slightly arcuate side portions.

7. The system in accordance with claim 4 in which said peripheral wall is a closure body that includes a snap-fit bead for engaging a snap-fit receiving structure on a container.

8. The system in accordance with claim 4 in which said first lid and said second lid each has a peripheral flange for depending alongside an upper portion of said peripheral wall.

9. The system in accordance with claim 8 in which said peripheral flange of each said lid has a laterally inwardly extending latch bead; and said peripheral wall has a laterally outwardly extending latch bead for engaging said laterally inwardly extending latch bead of said first lid and for engaging said laterally inwardly extending latch bead of said second lid.

10. The system in accordance with claim 4 in which said first and second film hinges are parallel.

11. The system in accordance with claim 4 in which said peripheral wall includes a lift tab projecting laterally outwardly beyond one of said lids when said one lid is closed.

12. The system in accordance with claim 4 in which said first access region narrow end includes a member projecting laterally inwardly.

* * * * *